US006177870B1

(12) United States Patent
Lian et al.

(10) Patent No.: US 6,177,870 B1
(45) Date of Patent: Jan. 23, 2001

(54) RESONANT EAS MARKER WITH SIDEBAND GENERATOR

(75) Inventors: Ming-Ren Lian; Hubert A. Patterson, both of Boca Raton, FL (US)

(73) Assignee: Sensormatic Electronics Corporation, Boca Raton, FL (US)

( * ) Notice: Under 35 U.S.C. 154(b), the term of this patent shall be extended for 0 days.

(21) Appl. No.: 09/229,185

(22) Filed: Jan. 13, 1999

(51) Int. Cl.[7] ..... G08B 13/14

(52) U.S. Cl. ..... 340/572.5; 340/572.1; 340/572.7

(58) Field of Search ..... 340/572.2, 572.5, 340/551, 572.7, 572.1

(56) References Cited

U.S. PATENT DOCUMENTS

| | | | | |
|---|---|---|---|---|
| 3,810,147 | | 5/1974 | Lichtblau | 340/280 |
| 4,352,098 | * | 9/1982 | Stephen et al. | 340/572.2 |
| 4,704,602 | * | 11/1987 | Åsbrink | 340/572.2 |
| 4,736,207 | * | 4/1988 | Siikarla et al. | 340/572.1 |
| 4,745,401 | * | 5/1988 | Montean | 340/572.5 |
| 5,065,137 | * | 11/1991 | Herman | 340/572.5 |
| 5,392,028 | * | 2/1995 | Pichl | 340/572.5 |
| 5,576,693 | * | 11/1996 | Tyren et al. | 340/572.5 |
| 5,760,580 | * | 6/1998 | Tyren | 340/572.5 |
| 5,812,065 | * | 9/1998 | Schrott et al. | 340/572.5 |

OTHER PUBLICATIONS

"A New Giant Magneto–Impedance Head Using Magnetic Microstrip Lines", Jiang, et al., IEEE Transactions on Magnetics, vol. 34. No. 4, Jul. 1998, pp. 1339–1341.

* cited by examiner

*Primary Examiner*—Daniel J. Wu
*Assistant Examiner*—John Tweel, Jr.
(74) *Attorney, Agent, or Firm*—Robin, Blecker & Daley

(57) ABSTRACT

A resonant RF electronic article surveillance marker includes a substrate, a coil formed on the substrate, and a capacitor formed on the substrate. The coil includes a magnetic element which exhibits a GMI effect. Two signals are employed to interrogate the marker—an RF carrier signal and a low-frequency alternating magnetic field. Because of the presence of the GMI element, the marker mixes the low frequency signal with the carrier signal to generate a sideband of the carrier signal. The sideband signal is very unique and can be detected with a high degree of reliability. The marker may also include magnetic control elements which can be magnetized to disable the marker and de-magnetized to reactivate the marker.

16 Claims, 3 Drawing Sheets

RESONANT EAS MARKER WITH SIDEBAND GENERATOR

FIELD OF THE INVENTION

This invention relates to electronic article surveillance (EAS) systems.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. Some markers are intended to be removed at the checkout counter upon payment for the merchandise. Other types of markers remain attached to the merchandise but are deactivated upon checkout by a deactivation device which changes a characteristic of the marker so that the marker will no longer be detectable at the interrogation zone.

A known type of EAS system employs markers which include an LC resonant circuit. An example of such a system is disclosed in U.S. Pat. No. 3,810,147. The circuit is typically formed on a substrate by printed or etched circuit techniques and includes a conductive path to form a coil on one side of the substrate. The coil is connected to a capacitor formed of capacitor plates that are on opposite sides of the substrate. The resonant circuit of the marker is tuned to a predetermined frequency. The detection equipment of the EAS system includes a transmitter which radiates an interrogation signal in the interrogation zone. The interrogation signal is swept through a frequency range which includes the predetermined tuning frequency of the marker. When an active marker is present in the interrogation zone, receiving equipment at the zone detects a change in the interrogation field at the tuned frequency because of the resonance of the resonant circuit of the marker.

It is known to provide a resonant circuit marker that can be deactivated by including in the marker circuitry a fusible link. The fusible link can be caused to fuse upon being energized by application of an electromagnetic field at a predetermined frequency, which may be the resonant frequency of the marker circuit itself, or the resonant frequency of a deactivation circuit associated with the fusible link. When the fusible link is energized and caused to fuse, an open circuit is formed in the resonant circuit of the marker, causing the marker to be detuned and no longer detectable by the detection portion of the EAS system.

As an alternative technique for deactivating resonant circuit markers, the dielectric between the capacitor plates may be broken down by application of a high energy pulse at the marker's tuned frequency. It is known, for example, to provide dimples in one of the capacitor plates, or to provide other structure which facilitates formation of a breakdown path between the capacitor plates.

Some improvements in known resonant circuit EAS markers are desirable. For example, it would be worthwhile to increase the reliability with which markers of this type can be detected. Further, it would be desirable to provide a marker that can be detected without using a swept-frequency interrogation transmitter. Furthermore, known techniques for deactivating resonant circuit markers are irreversible, in that once a fusible link is fused or the capacitor is broken down, the marker cannot be reactivated. It would be useful to provide a resonant circuit EAS marker that can be restored to an active condition after the marker has been deactivated.

OBJECTS AND SUMMARY OF THE INVENTION

It is an object of the invention to provide a resonant circuit EAS marker that can be more reliably detected than resonant circuit markers provided according to the prior art.

It is a further object of the invention to provide resonant circuit EAS markers that can be detected at a greater distance than prior art resonant circuit markers.

It is still another object of the invention to provide a resonant circuit EAS marker that can be restored to an activated condition after it has been deactivated.

It is yet another object of the invention to provide a resonant circuit EAS marker that can be deactivated by more than one technique.

According to a first aspect of the invention, there is provided a resonant EAS marker of the radio-frequency type, including a substrate, a coil formed on the substrate and including a magnetic element, and a capacitor formed on the substrate and connected to the coil.

According to a preferred embodiment of the invention, the magnetic element included in the coil exhibits a giant magneto-impedance (GMI) effect when a bias magnetic field is applied to the magnetic element. A marker of this type may be interrogated by simultaneously transmitting a carrier signal at the marker's resonant frequency and a low frequency alternating magnetic field. Because of the presence of the GMI element, the marker functions to mix the carrier frequency and the low frequency of the magnetic field, forming a sideband of the carrier frequency that can be detected by suitable receiving equipment provided as part of the EAS system.

According to a second aspect of the invention, there is provided an EAS marker which includes a support member sized for application to an article of merchandise, and circuitry on the support member for performing a first function of receiving and re-radiating a first signal at a first frequency and a second function of receiving a second signal at a second frequency that is lower than the first frequency and mixing the second signal with the first signal, wherein the portion of the circuitry for performing the first function includes a conductive layer formed on said support member and the portion of the circuitry for performing the second function includes a magnetic element.

According to a third aspect of the invention, there is provided a resonant EAS marker of the radio-frequency type, including an inductive element, a capacitive element connected to the inductive element, a first deactivation mechanism associated with at least one of the inductive element and the capacitive element, for reversibly deactivating the marker, and a second deactivation mechanism, associated with at least one of the inductive element and the capacitive element, for irreversibly deactivating the marker.

A resonant circuit EAS marker provided in accordance with the invention, by virtue of including a GMI magnetic element, generates a marker signal in the form of sidebands of a carrier RF signal. A marker signal of this type can be detected more reliably and at a greater distance than the signals provided by conventional resonant circuit markers.

Furthermore, deactivation elements may be provided in association with the GMI element and may be selectively magnetized to inhibit the GMI effect. When this occurs, the marker no longer generates the sideband signal and cannot be detected, thus being rendered deactivated. The marker may be restored to its active state by degaussing the deactivation elements. A conventional, irreversible, deactivation feature may also be provided, such as a fusible link or a breakdown path between capacitor plates, in accordance with conventional practice.

The foregoing, and other objects, features and advantages of the invention will be further understood from the following detailed description of preferred embodiments and from the drawings, wherein like reference numerals identify like components and parts throughout.

DESCRIPTION OF PREFERRED EMBODIMENTS

Preferred embodiments of the invention will now be described, with reference to the drawings.

Figure 1:
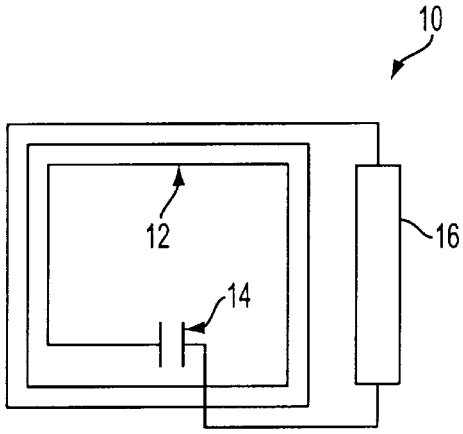
FIG. 1 is a schematic illustration of a resonant circuit provided according to the invention in an EAS marker, where the resonant circuit includes a GMI magnetic element.

Referring initially to FIG. 1, reference numeral 10 generally indicates a resonant circuit provided, in accordance with the invention, as the active component of an EAS marker. The circuit 10 includes a coil indicated at 12 and a capacitor connected to the coil and indicated at 14. One leg of the coil 12 is constituted by a magnetic element 16. The magnetic element is of a type which exhibits a so-called "giant magneto-impedance" (GMI) effect. GMI effects have been extensively studied in recent years and are said to occur when a voltage induced by a high frequency current source in a ferromagnetic wire is caused to change substantially by applying an external magnetic field to the wire. The magnetic element 16 may take the form of a 6 cm length of amorphous cobalt-based wire, having a diameter of 116 microns. The amorphous cobalt-alloy wire may be formed by a conventional technique such as casting in rotating water or melt extraction. The permeability of the wire may be enhanced and a circumferential anisotropy developed by current-annealing the wire. The magnetic element 16 may be fixed at its position in the coil 12 by techniques such as spot welding or adhesion by conductive cement. A thin film which has GMI characteristics may be employed instead of cast amorphous wire.

Figure 2:
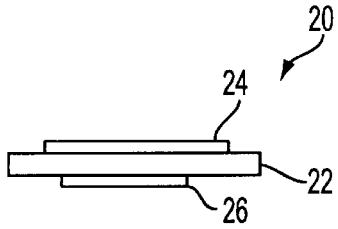
FIG. 2 is a somewhat schematic side view of a marker which includes the circuit of FIG. 1.

FIG. 2 is a side view of a marker 20 which includes the resonant circuit 10 shown in FIG. 1. Structural support for the marker 20 is provided by a conventional marker substrate 22. A conductive trace layer 24 formed on the top side of the substrate 22 may correspond to all elements of the resonant circuit 10 except for one plate of the capacitor 14. It is to be understood that the magnetic element 16, although not separately shown in FIG. 2, is inserted into a portion of the layer 24.

A second conductive layer 26, provided at an opposite (bottom) side of the substrate 22, constitutes the portion of capacitor 14 not included in the top conductive layer 24.

As an alternative to placing the second conductive layer 26 on the opposite side of the substrate 22 from the first conductive layer 24, it is contemplated to form a dielectric layer (not shown) on top of the first conductive layer 24, and then to form the second conductive layer 26 on top of the dielectric layer.

As will be understood by those who are skilled in the art, the marker as shown in FIG. 2 may be laminated between paper or plastic sheets (not shown) to cover and protect the resonant circuit, and to form a base on which an adhesive may be applied.

Except for the magnetic element 16, the conductive layers 24 and 26 may be formed on the substrate 22 in accordance with conventional practice. It will also be understood that a requisite connection or connections between the layers 24 and 26, though not shown, are also provided in accordance with conventional practice.

Figure 3:
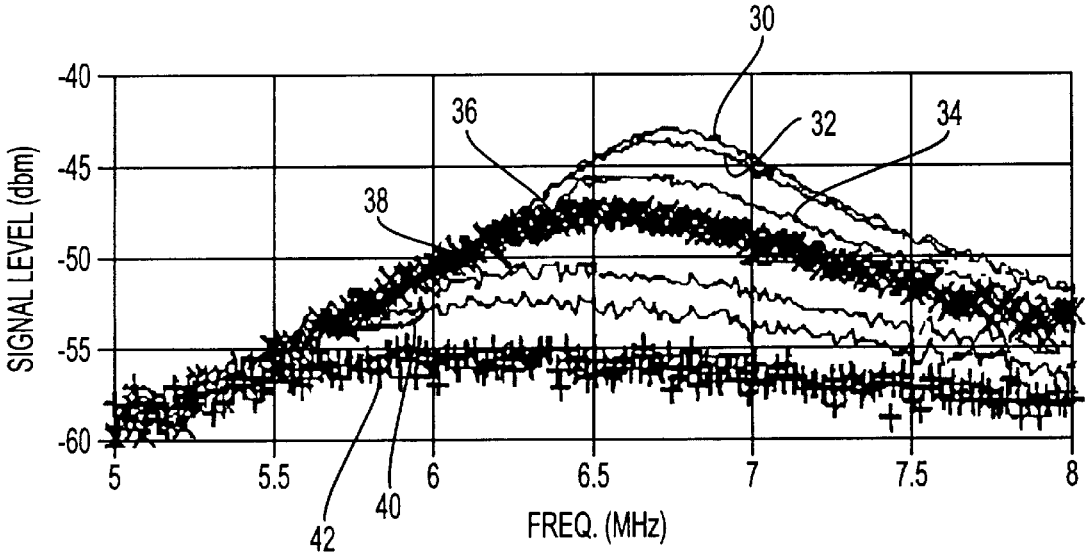
FIG. 3 shows signal level traces for the marker of FIGS. 1 and 2 for respective levels of a DC bias magnetic field applied to the marker.

FIG. 3 illustrates how variations in the level of a DC bias magnetic field, applied along the length of the magnetic element 16, affect the level of a signal output from the marker in response to a swept interrogation signal. Seven traces are shown in FIG. 3, corresponding, respectively, to seven different levels of the DC bias field. The top trace, which is labelled with reference numeral 30, corresponds to a bias level of 0.11 Oe. The next trace, labelled 32, corresponds to a 0.28 Oe bias level. The next trace, labelled 34, corresponds to a 0.40 Oe bias field level. Trace 36, formed of "x" marks, corresponds to a bias field level of 0.49 Oe. The succeeding trace, indicated by reference numeral 38, is for a 0.63 Oe bias field level. Trace 40 corresponds to a bias field level of 0.71 Oe, and the bottom trace, indicated by reference numeral 42, and made up of "+" marks, corresponds to a bias field level of 0.83 Oe.

FIG. 3 indicates that at a very minimal bias field, of about 0.11 Oe or below, the marker 20 exhibits substantial resonance at its tuned frequency, which is 6.725 MHz in a preferred embodiment. As the bias field is increased by small amounts, measured in the tenths of an Oersted, the resonance of the circuit is decreased until it is substantially eliminated at a bias field level of about 0.8 Oe. The reduction in the resonance is due to the GMI effect imparted to the magnetic element 16 by the bias field.

Figure 4:
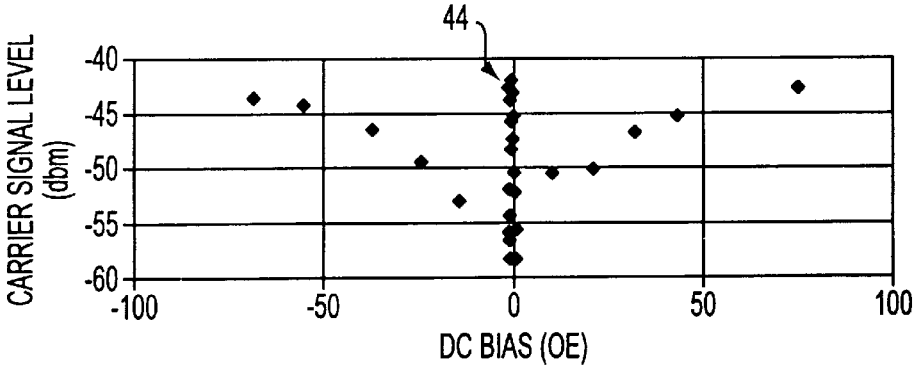
FIG. 4 shows carrier signal intensity levels of the marker of FIGS. 1 and 2 at various DC bias field levels.

FIG. 4 is another graph which illustrates how the signal level output from the marker, when excited by a 6.725 MHz signal, varies over a range of bias field values measured in tens of Oersted. A central spike indicated at 44 in FIG. 4 represents the large decrease in resonance which occurs as the absolute value of the bias field level is increased by a small amount from a substantially zero level. The amount of resonance then increases gradually as the absolute value of the bias field level continues to be increased by tens of Oersteds. At around 75 or 80 Oe, a high degree of resonance is again achieved.

Figure 5:
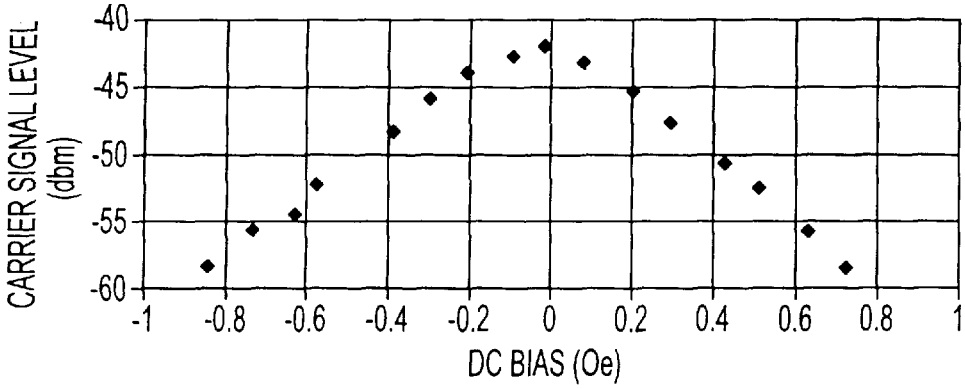
FIG. 5 is a graph that is similar to FIG. 4, showing a region of the graph of FIG. 4 near the bias field origin point.

FIG. 5 shows the portion of the graph 4 near the spike 44, as presented on a larger horizontal scale. As also seen in FIG. 3, the signal level is reduced to a very low level as the absolute value of the DC bias field increases to about 0.8 Oe.

Figure 5A:
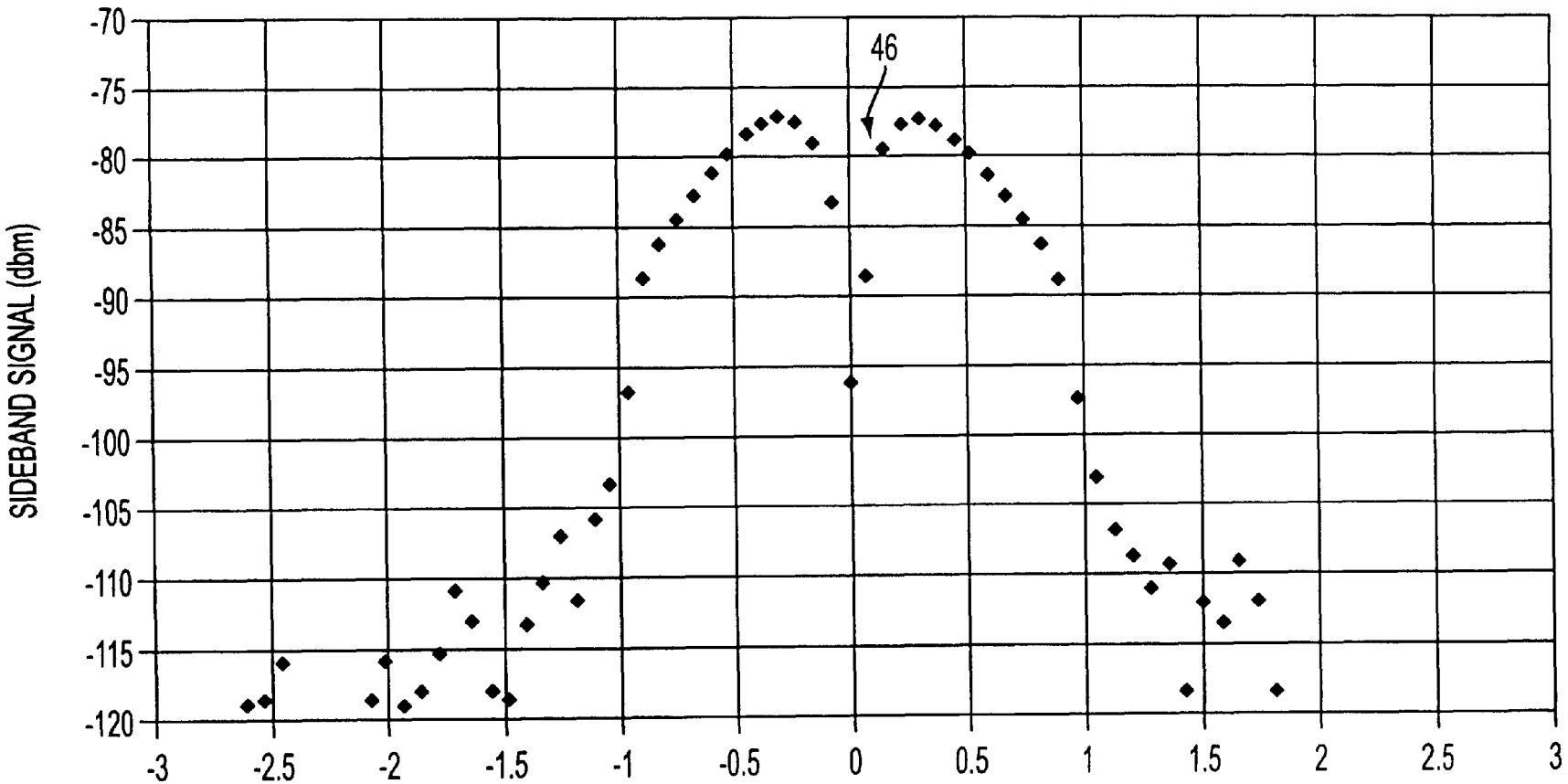
FIG. 5A shows sideband signal intensity levels of the marker of FIGS. 1 and 2 at various DC bias field levels.

FIG. 5A shows how the sideband signal intensity varies with changes in a DC bias magnetic field applied to a marker provided in accordance with the invention and excited by both a 6.725 MHz carrier signal and a 1 kHz magnetic field having a peak amplitude of 31 mOe. It will be observed that the sideband signal intensity is relatively high for bias field levels having an absolute value of 1 Oe or less, except for a trough near a zero bias field level, as indicated at 46 in FIG. 5A. The trough 46 is due to the zero slope at the origin of the carrier signal intensity/bias field curve of FIG. 5. In practice, the effect of the earth's magnetic field is usually sufficient to bias the marker slightly away from the trough region 46.

It will also be understood from FIG. 5A that application of a bias field of about 3 Oe would be sufficient to prevent the marker from generating a substantial sideband signal.

Figure 6:
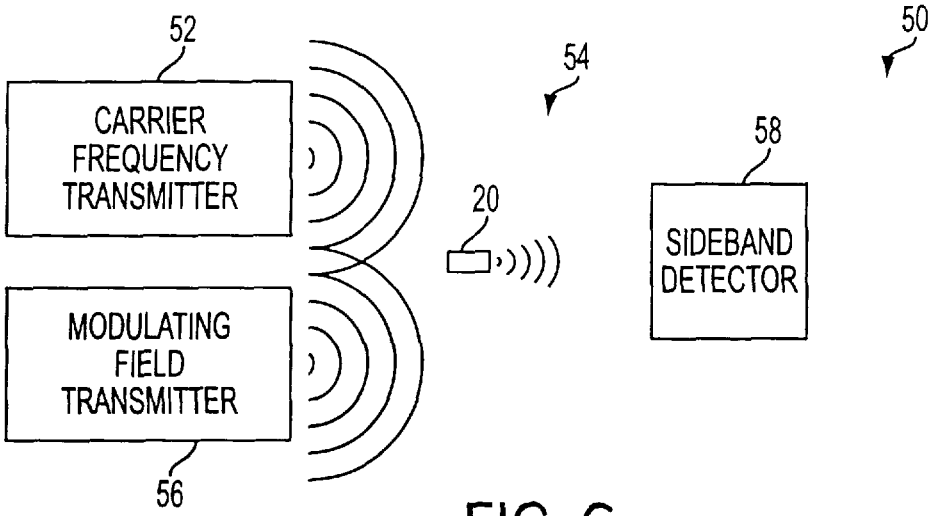
FIG. 6 is a schematic block diagram illustration of an EAS system provided in accordance with the invention.

FIG. 6 illustrates an electronic article surveillance system provided in accordance with the invention to capitalize on the unique properties of the marker illustrated in FIGS. 1 and 2.

In FIG. 6, reference numeral 50 generally indicates the EAS system provided in accordance with the invention.

One system component is a single frequency transmitter 52 which transmits a signal at the marker's tuned frequency into interrogation zone 54. The signal generated by the transmitter 52 would be 6.725 MHz assuming that, as mentioned above, the marker 20 is tuned to be resonant at that frequency. However, a marker tuned to any other conventional RF tag frequency may be used, and indeed, a much higher frequency, such as 50 MHz, could be the tuning frequency of the marker, in which case the coil element of the marker's resonant circuit would consist of a single turn. In any case, the frequency of the signal transmitted by the transmitter 52 is matched to the resonant frequency of the marker.

Another component of the system 50 is a modulating field transmitter 56. The transmitter 56 transmits into the interrogation zone 54 a magnetic field that alternates at a frequency which is considerably lower than the frequency of the carrier signal transmitted by the transmitter 52. For example, the frequency of the alternating magnetic field may be about 1 kHz.

The transmitter 56 may generate the alternating magnetic field by an antenna which is a loop having dimensions of approximately 2 feet by 1.5 feet. It is well within the ability of those of ordinary skill in the art to design circuitry for driving the antenna to generate the alternating magnetic field.

Because of the GMI effect exhibited by the magnetic element 16 of the marker 20, the marker 20 is repetitively de-tuned at the frequency of the magnetic field generated by the transmitter 56. Consequently, the marker 20 operates to mix the frequency of the magnetic field transmitted by the transmitter 56 with the carrier signal transmitted by the transmitter 52, to form a sideband of the carrier signal. This sideband signal is very unique, and can be readily received and reliably detected by a sideband detector 58, with little likelihood of generating false alarms. The sideband detector 58 also constitutes a part of the EAS system 50 shown in FIG. 6, and can be designed without difficulty by those of ordinary skill in the art.

Figure 7:
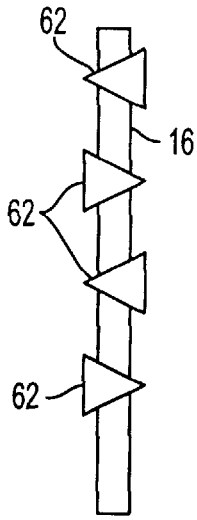
FIG. 7 is an enlarged view of a magnetic element that may be included in the circuit of FIG. 1.

FIG. 7 schematically shows the magnetic element 16 of FIG. 1 with control or deactivation elements 62 installed along the length of the magnetic element 16. Although the magnetic element 16 is portrayed in FIG. 7 as being a ribbon-shaped length of material, it is to be understood that the magnetic element 16 may also be embodied in the form of a wire, so long as it exhibits the required GMI effect.

The control elements 62 may be formed of a conventional semi-hard magnetic material. ("Semi-hard" means having a coercivity in the range of about 10 Oe to about 500 Oe.) In a procedure for deactivating the marker, a DC magnetic field is applied to the marker at a level that is high enough to magnetize the control elements 62. When the control elements 62 are magnetized, the localized bias fields provided by the elements 62 break up the magnetic domains of the magnetic element 16, and prevent the magnetic element 16 from showing a substantial GMI effect. This disables the marker 20 from generating the sideband signal to be detected by the sideband detector circuit 58, thus rendering the marker 20 inactive. To reactivate the marker, the control elements 62 may be degaussed.

The triangular shape of the control elements 62, and the arrangement of the elements 62 with alternating orientations along the length of the magnetic element 16, as shown in FIG. 7, help to make the deactivation procedure largely insensitive to the orientation at which the marker 20 is presented for deactivation.

The control elements 62 may be formed in other shapes (such as those portrayed in co-pending patent application Ser. No. 09/219,921 (attorney docket no. C4-674)), including rectangular shapes; and a single, large control element, extending substantially along the length of the magnetic element 16, may be substituted for the small triangular control elements 62 shown in FIG. 7.

In addition to the mechanism for reversible deactivation provided by the control elements 62, the marker 20 may also be equipped with a conventional nonreversible deactivation mechanism, such as a breakdown path between capacitor plates and/or a fusible link. These additional mechanisms are not separately shown in the drawings, but are well known to those of ordinary skill in the art.

Although the magnetic element 16 is, according to a preferred embodiment, provided as only one leg of the coil 12 shown in FIG. 1, it is contemplated according to an alternative embodiment of the invention to form all of the conductive layer 24 (FIG. 2), which constitutes the entire coil 12 and one plate of the capacitor 14, from a magnetic material which exhibits a GMI effect. A suitable control element or group of control elements could also be included in such an alternative embodiment.

By incorporating a magnetic element which exhibits a GMI effect in a resonant RF electronic article surveillance marker, the signal generated by the marker can be made much more unique than a conventional single frequency marker signal, and easier to detect with reduced probability of false alarms. The unique signal is achieved by adding a low frequency modulating magnetic field generator to tag excitation circuitry, and then detecting the sideband signal formed when the marker mixes the low frequency signal with an excitation signal transmitted at the marker's resonant frequency.

Various changes in the foregoing marker and system embodiments may be introduced without departing from the invention. The particularly preferred embodiments are thus intended in an illustrative and not limiting sense. The true spirit and scope of the invention are set forth in the following claims.

What is claimed is:

1. A resonant EAS marker of the radio-frequency type, comprising:

a substrate;

a coil formed on said substrate and including a magnetic element, said magnetic element exhibiting a giant magneto-impedance effect when a magnetic field is applied to said magnetic element; and a capacitor formed on said substrate and connected to said coil.

2. A resonant EAS marker according to claim 1, wherein said coil is substantially entirely formed of said magnetic element.

3. A resonant EAS marker according to claim 1, further comprising a control element adjacent to said magnetic element, said control element for being selectively magnetized to deactivate the marker.

4. A resonant EAS marker according to claim 3, wherein said control element exhibits semi-hard magnetic properties.

5. An EAS marker, comprising:

a support member sized for application to an article of merchandise;

first means, on said support member, for receiving and re-radiating a first signal at a first frequency; and second means, on said support member and connected to said first means, for receiving a second signal at a second frequency that is lower than said first frequency, and mixing said second signal with said first signal;

wherein said first means includes a conductive layer deposited on said support member and said second means includes a magnetic element, said magnetic element exhibiting a giant magneto-impedance effect when a bias magnetic field is applied to said magnetic element.

6. An EAS marker according to claim 5, wherein said first means includes a coil and a capacitor.

7. A resonant EAS marker of the radio-frequency type, comprising:

an inductive element including a magnetic element exhibiting a giant magneto-impedance effect;

a capacitive element connected to said inductive element;

first deactivation means, associated with said inductive element, for reversibly deactivating the marker; and second deactivation means, associated with at least one of said inductive element and said capacitive element, for irreversibly deactivating the marker.

8. A resonant EAS marker according to claim 7, wherein said first deactivation means includes a semi-hard magnetic element associated with said inductive element.

9. A resonant EAS marker according to claim 7, wherein said second deactivation means includes means for breaking down said capacitive element.

10. In a resonant EAS marker of the radio-frequency type which includes a substrate, and a coil and a capacitor formed on the substrate, the improvement comprising:

a magnetic element which constitutes at least a part of the coil, said magnetic element exhibiting a giant magneto-impedance effect when a bias magnetic field is applied to said magnetic element.

11. The invention according to claim 10, wherein said coil is substantially entirely formed of said magnetic element.

12. The invention according to claim 10, further comprising a control element adjacent to said magnetic element, said control element for being selectively magnetized to deactivate the marker.

13. The invention according to claim 12, wherein said control element exhibits semi-hard magnetic properties.

14. An EAS system, comprising:

interrogation means for generating a carrier signal at a first frequency and a magnetic field which alternates at a second frequency lower than said first frequency;

a marker which includes a substrate, a coil formed on said substrate and a capacitor formed on said substrate, said coil including a magnetic element exhibiting a giant magneto-impedance effect, said marker generating a sideband of said carrier signal; and detection means for detecting the sideband generated by said marker.

15. An EAS system according to claim 14, wherein said magnetic element is a cobalt-based amorphous wire.

16. A method of operating an EAS system, the method comprising the steps of:

providing a marker which includes a tuned LC circuit and a magnetic element which exhibits a giant magneto-impedance effect;

transmitting a carrier signal at a resonant frequency of said LC circuit;

generating an alternating magnetic field at a frequency that is lower than said resonant frequency; and detecting a sideband of said carrier signal, said sideband being generated by said marker mixing said alternating magnetic field with said carrier signal.

* * * * *